US005611712A

United States Patent [19]

Morishita et al.

[11] Patent Number: 5,611,712

[45] Date of Patent: Mar. 18, 1997

[54] CONNECTOR WITH TERMINAL STOPPER ATTACHED AND METHOD FOR INSERTING AND STOPPING TERMINAL FITTINGS USING SAME

[75] Inventors: Kazuhiro Morishita; Hiraji Takase, both of Shizuoka-ken, Japan

[73] Assignee: Yazaki Corporation, Tokyo, Japan

[21] Appl. No.: 262,312

[22] Filed: Jun. 17, 1994

[30] Foreign Application Priority Data

Jun. 18, 1993 [JP] Japan ..... 5-147484

[51] Int. Cl.[6] ..... H01R 13/514

[52] U.S. Cl. ..... 439/752

[58] Field of Search ..... 439/733, 752, 439/592–599, 374, 378

[56] References Cited

U.S. PATENT DOCUMENTS

| | | | |
|---|---|---|---|
| 4,946,398 | 8/1990 | Takenouchi et al. | 439/752 |
| 5,059,142 | 10/1991 | Ohta et al. | 439/752 |
| 5,061,210 | 10/1991 | Jinno | 439/752 |
| 5,123,866 | 6/1992 | Endo et al. | 439/752 |
| 5,139,447 | 8/1992 | Yoneda et al. | 439/752 |
| 5,145,419 | 9/1992 | Yamanashi et al. | 439/752 |
| 5,209,676 | 5/1993 | Endo et al. | 439/752 |
| 5,292,261 | 3/1994 | Hirano et al. | 439/752 |
| 5,322,457 | 6/1994 | Tsuji et al. | 439/752 |

FOREIGN PATENT DOCUMENTS

| | | | |
|---|---|---|---|
| 2113275 | 9/1990 | Japan | H01R 13/42 |
| 381978 | 4/1991 | Japan | H01R 13/42 |

*Primary Examiner*—P. Austin Bradley
*Assistant Examiner*—Jill Demello
*Attorney, Agent, or Firm*—Sughrue, Mion, Zinn, Macpeak & Seas

[57] ABSTRACT

In a connector with a terminal stopper attached according to the invention, a terminal stopper to be fitted in the rear of a connector housing is provided with a guide bar, a connector housing is provided with an introduction section and the terminal stopper is fitted into the connector housing by inserting the guide bar in the introduction section.

The connector with the terminal stopper attached of the present invention allows an easy and exact insertion of the terminal stopper into the connector housing, thereby securely stopping terminal fittings and is excellent in workability when assembled and has superior reliability.

9 Claims, 4 Drawing Sheets

CONNECTOR WITH TERMINAL STOPPER ATTACHED AND METHOD FOR INSERTING AND STOPPING TERMINAL FITTINGS USING SAME

FIELD OF THE INVENTION

This invention relates to a connector, which is used to connect wire harnesses or the like, having a terminal stopper disposed at the rear of a connector housing to prevent terminal fittings which are inserted in terminal accommodating chambers of the connector housing from inadvertently being removed.

BACKGROUND OF THE INVENTION

A means integrally disposing flexible stopper arms on the internal wall of terminal accommodating chambers of a connector housing and connecting the flexible stopper arms to terminal fittings to be inserted is generally used to stop the terminal fittings and to prevent them from coming off afterward. And, there is another proposal fitting a terminal stopper at the rear of the connector housing so as to cooperate with or to work instead of the above flexible stopper arms to secure the prevention of late coming off of the terminal fittings.

As shown in a conventional example of FIG. 6, when inserting and stopping terminal fittings in a connector provided with the above terminal stopper, a terminal fitting c to which an electrical wire w is connected is inserted into a terminal accommodating chamber of a connector housing under the condition that a terminal stopper b is temporarily inserted into the rear of the connector housing, thereby the terminal stopper b is inserted into a predetermined position.

When the terminal fitting c is incompletely inserted, the terminal stopper b is not fitted into an appropriate position. If the connector housing 'a' is inserted into a connector housing accommodating section e of a relay box d as shown in FIG. 7 under this condition, the incomplete insertion of the terminal fitting c and the terminal stopper b is not apparent. As a result, if a trouble is caused in a circuit, lots of time and labor are needed to detect the troubled part and repair it.

SUMMARY OF THE INVENTION

The present invention is to provide a connector with a terminal stopper attached which allows an easy and exact insertion of the terminal stopper into a connector housing, can securely stop terminal fittings, is excellent in workability when assembled and has superior reliability.

The connector with the terminal stopper attached according to the present invention comprises a connector housing having a plurality of terminal accommodating chambers, a plurality of terminal fittings to be inserted in the terminal accommodating chambers and a terminal stopper fitted in the rear of the connector housing, and is characterized by disposing a guide bar on the terminal stopper, forming an introduction section in the connector housing to connect with the guide bar and inserting the guide bar in the introduction section so that the terminal stopper is fitted into the connector housing.

Further, the connector with the terminal stopper attached according to the present invention is characterized in that the terminal stopper and the connector housing each is provided with the guide bar and the introduction section to connect with the guide bar, and the respective guide bar is inserted in the each introduction section so that the terminal stopper is fitted into the connector housing.

The method for inserting and stopping the terminal fittings according to the present invention in which the terminal fittings housed in the terminal accommodating chambers are stopped by means of the terminal stopper fitted in the rear of the connector housing is characterized by disposing the guide bar on the terminal stopper which is inserted in the introduction section disposed in the connector housing and thereby exactly fitting the terminal stopper into the connector housing.

In addition, the method for inserting and stopping the terminal fittings according to the present invention is characterized by disposing the guide bar as well as the introduction section on the terminal stopper and in the connector housing respectively, and inserting each guide bar into each inserting section, thereby exactly fitting the terminal stopper into the connector housing.

According to the invention, the terminal stopper can be easily and exactly fitted into the connector housing resulting in securely stopping the terminal fittings.

DETAILED DESCRIPTION OF THE INVENTION

Figure 1:
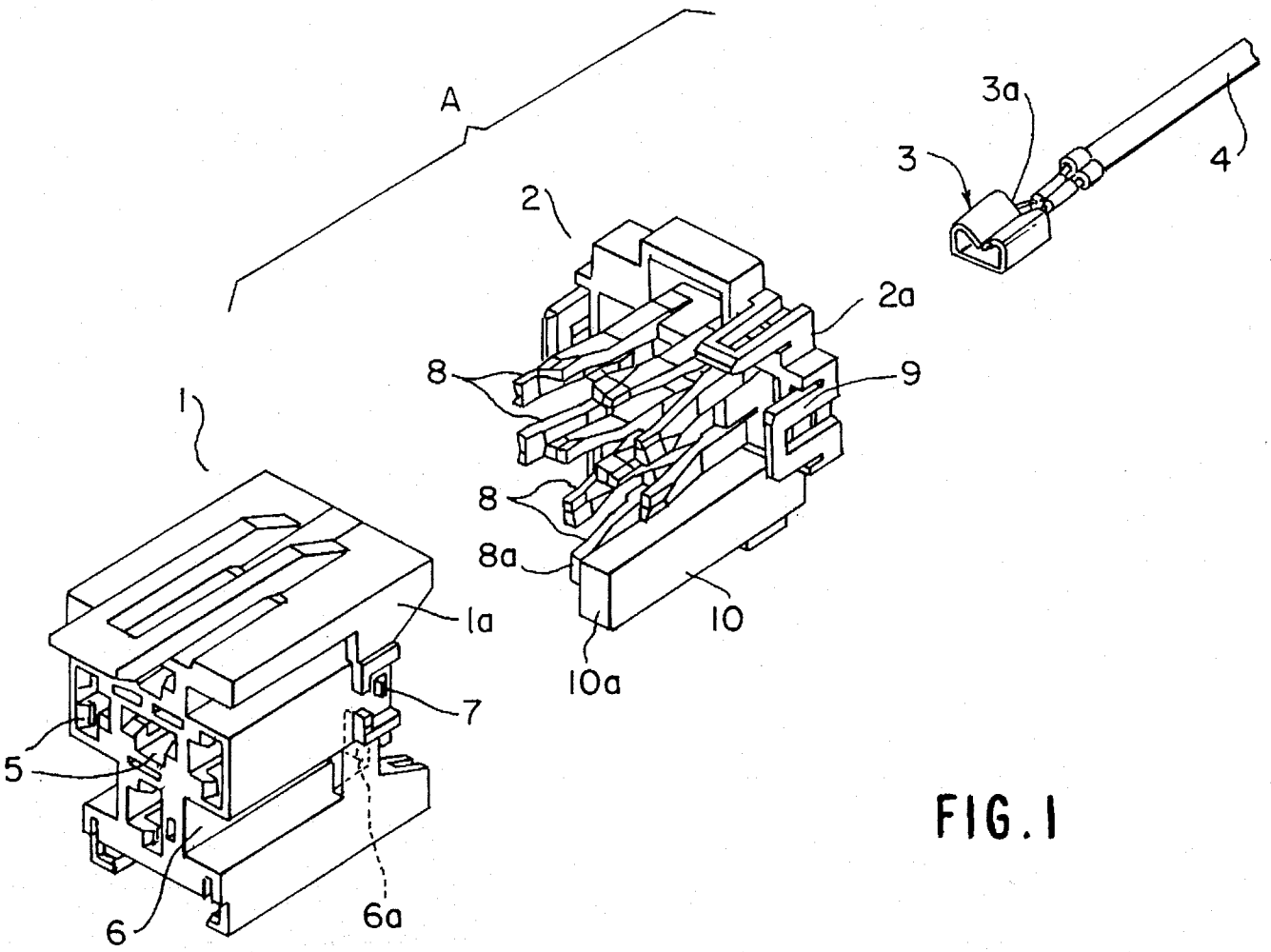
FIG. 1 is a perspective view separately showing the components of a connector with a terminal stopper attached of the present invention.

A connector with a terminal stopper attached according to the invention comprises a connector housing having a plurality of terminal accommodating chambers, a plurality of terminal fittings to be inserted in the terminal accommodating chambers, and a terminal stopper to be fitted at the rear of the connector housing. The terminal stopper is provided with a guide bar, the connector housing is provided with an introduction section to be connected to the guide bar, and the guide bar is inserted in the introduction section so as to fit the terminal stopper into the connector housing when the connector is assembled. It is preferable that the guide bar disposed on the terminal stopper is formed to protrude in a direction to which the terminal stopper is advanced to be fitted into the connector housing and has a length enough to have its leading end reached to the end of the introduction section of the connector housing when the terminal stopper is fitted in the connector housing. Also, the guide bar preferably have a length exceeding the leading ends of the terminal stopping sections of the terminal stopper.

The disposition of the guide bar on the terminal stopper and the introduction section which is connected to the guide bar in the connector housing makes it easy to exactly fit the terminal stopper into the connector housing. And, since the guide bar has a length so that its leading end exceeds the leading ends of the terminal stopping sections of the terminal stopper, the leading end of the guide bar is the first to contact the connector housing when the terminal stopper is advanced to be fitted in the assembling process so that the terminal stopping sections are prevented from being broken caused by their contact with the peripheral wall of the connector housing.

As the guide bar has a length so that its leading end comes to the end of the introduction section of the connector housing when the terminal stopper is fitted into the connector housing, if the leading end of the guide bar is positioned at the end of the introduction section of the connector housing, it is confirmed that the terminal stopper is completely inserted, and when the guide bar does not reach the end of the introduction section, incomplete insertion of the terminal stopper can be detected.

Further, a connector with a terminal stopper attached of the invention comprises a connector housing having a plurality of terminal accommodating chambers, a plurality of terminal fittings to be inserted in the terminal accommodating chambers, and a terminal stopper to be fitted to the rear of the connector housing, and is characterized by providing the connector housing with a guide bar, forming an introduction section to be connected to the guide bar on the terminal stopper, and inserting the guide bar in the introduction section to fit the terminal stopper into the connector housing. The guide bar is preferably formed at the side of the connector housing where the terminal stopper is accommodated and has a length so that its leading end comes to the end of the introduction section of the terminal stopper when the terminal stopper is fitted into the connector housing.

The disposition of the guide bar in the connector housing and the introduction section which is connected to the guide bar on the terminal stopper makes it easy to exactly fit the terminal stopper into the connector housing. And, when the terminal stopper is fitted into the connector housing, if the leading end of the guide bar is positioned at the end of the introduction section of the terminal stopper, it is confirmed that the terminal stopper is completely inserted, and in case that the guide bar does not reach the end of the introduction section, incomplete insertion of the terminal stopper can be detected.

In addition, a connector with a terminal stopper attached of the present invention comprises a connector housing having a plurality of terminal accommodating chambers, a plurality of terminal fittings to be inserted in the terminal accommodating chambers, and a terminal stopper to be fitted to the rear of the connector housing, and is characterized by forming a guide bar and an introduction section to be connected to the guide bar on the terminal stopper and the connector housing respectively, and inserting each guide bar in each introduction section to fit the terminal stopper into the connector housing. The terminal stopper is provided with the guide bar which protrudes in a direction to where the terminal stopper is advanced to be fitted into the connector housing, while the connector housing is provided with the guide bar at the side where the terminal stopper is accommodated. It is preferable that each guide bar has a length so that respective leading end comes to the end of the introduction section of the terminal stopper or the connector housing when the terminal stopper is fitted into the connector housing. The guide bar disposed on the terminal stopper preferably have a length exceeding the leading ends of the terminal stopping sections of the terminal stopper.

The disposition of the guide bar and the introduction section on the terminal stopper and the connector housing respectively makes it easy to exactly fit the terminal stopper into the connector housing. In addition, since the guide bar disposed on the terminal stopper has a length so that its leading end exceeds the leading ends of the terminal stopping sections of the terminal stopper, the leading end of the guide bar is the first to contact the connector housing when the terminal stopper is advanced to be fitted into the connector housing in the assembling process, so that the terminal stopping sections are prevented from being broken due to their contact with the peripheral wall of the connector housing.

When the terminal stopper is fitted into the connector housing, in case that the leading end of each guide bar is positioned at the end of the respective introduction sections of the terminal stopper and the connector housing, it is confirmed that the terminal stopper is completely inserted, and if either or both of the leading ends of the guide bars do not reach the ends of the introduction sections of the terminal stopper and/or the connector housing, incomplete insertion of the terminal stopper is detected.

According to the present invention, a method for inserting and stopping the terminal fittings in the terminal accommodating chambers by the terminal stopper fitted to the rear of the connector housing is characterized in that the guide bar disposed on the terminal stopper is inserted in the introduction section formed in the connector housing to exactly fit the terminal stopper into the connector housing, thereby ensuring the insertion and stopping of the terminal fittings.

Further, a method for inserting and stopping the terminal fittings in the terminal accommodating chambers by the terminal stopper fitted to the rear of the connector housing is characterized in that the guide bar disposed in the connector housing is inserted in the introduction section disposed on the terminal stopper so as to securely fit the terminal stopper into the connector housing resulting in exact insertion and stopping of the terminal fittings.

In addition, a method for inserting and stopping the terminal fittings in the terminal accommodating chambers by the terminal stopper fitted to the rear of the connector housing is characterized in that the guide bars respectively disposed on the terminal stopper and in the connector housing are inserted in the introduction sections disposed in the connector housing and on the terminal stopper, each so that the terminal stopper is surely fitted into the connector housing and the terminal fittings are securely inserted and stopped as a result.

According to the present invention, the terminal stopper is surely fitted into the connecter housing as the guide bar is provided on the terminal stopper and/or in the connector housing and the introduction section is formed in the connector housing and/or on the terminal stopper. As a result, the terminal fittings can be securely inserted and stopped in the terminal accommodating chambers. In addition, even if the terminal fittings are incompletely inserted in the terminal accommodating chambers, such a defect can be detected by checking the guide bar provided on the terminal stopper and/or in the connector housing to reach the end of the introduction section formed in the connector housing and/or on the terminal stopper.

EXAMPLES

FIG. 1 is a perspective view separately showing the components of a connector 'A' with a terminal stopper attached of the present invention.

The connector 'A' comprises a connector housing 1, a terminal stopper 2 to be fitted into the rear of the connector housing 1, and a terminal fitting 3 to be inserted and retained in a terminal accommodating chamber 5 of the connector housing 1. Reference numeral 4 represents an electrical wire connected to the terminal fitting 3.

The connector housing 1 has a plurality of terminal accommodating chambers 5 disposed in parallel, and a groove-shaped introduction section 6 disposed adjacent to the terminal accommodating chamber at the outer periphery of the connector housing. A stopper claw 7 is disposed to protrude on an outer wall '1*a*' in order to stop the terminal stopper 2.

Figure 3:
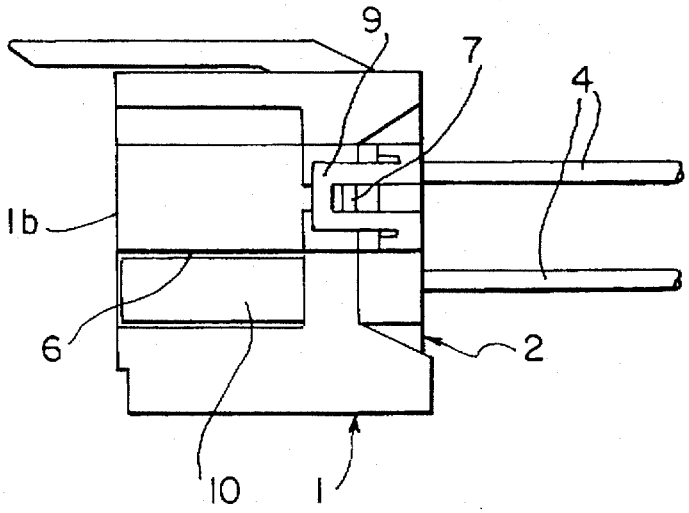
FIG. 3 is a side view of the connector with the terminal stopper attached of the present invention.

On the terminal stopper 2, a plurality of flexible terminal stopping sections 8 are disposed to correspond to the terminal accommodating chambers 5 so as to be connected to a stopping section '3*a*' of the terminal fitting 3 to be accommodated in the terminal accommodating chambers 5 of the connector housing, thereby preventing the terminal fitting 3 from coming off afterward. An outer periphery '2*a*' has a detent 9 which connects with the stopper claw 7 of the connector housing 1 and a guide bar 10 which is protruded in a direction to which the terminal stopper 2 is advanced to be fitted into the connector housing 1. The guide bar 10 has a cross-sectional form to fit with the introduction section 6 of the connector housing 1. The length of the guide bar 10 to its leading end face '10*a*' is determined to be equal to or a little longer than a length of the terminal stopping section 8 to its leading end '8*a*', and moreover, as shown in the side view of FIG. 3, the guide bar 10 has a length so that the leading end face '10*a*' is flush with an end 1*b* of the introduction section of the connector housing when the terminal stopper 2 is completely fitted into the connector housing 1.

Figure 2:
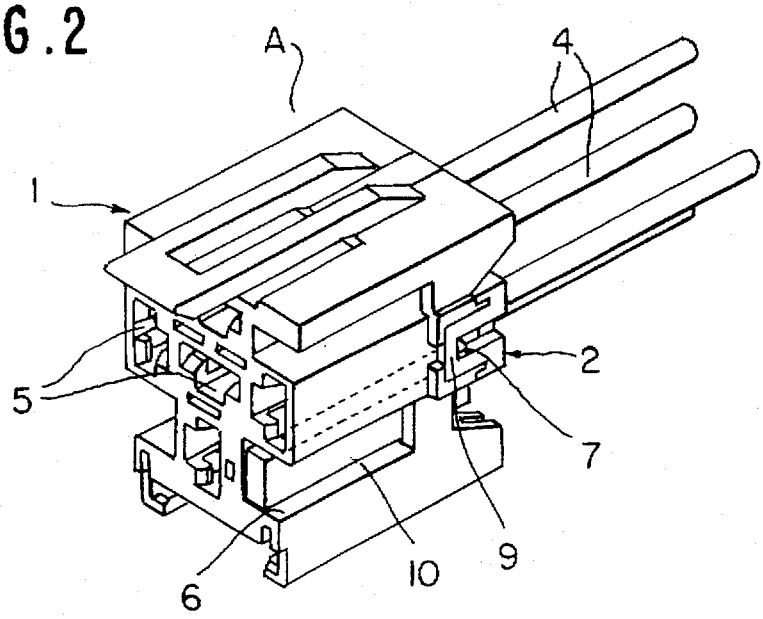
FIG. 2 is a perspective view showing a state that the terminal stopper and the terminal fittings are inserted into the connector housing of the present invention.

To fit the terminal stopper 2 into the connector housing 1, the guide bar 10 of the terminal stopper 2 is fitted with an insertion port '6*a*' of the introduction section 6 of the connector housing 1 and inserted along the introduction section 6, then the stopper claw 7 of the connector housing 1 and the detent 9 of the terminal stopper 2 are connected and the connector housing and the terminal stopper are engaged as shown in FIG. 2. In this case, directionality is maintained for the terminal stopper 2 by sliding the guide bar 10 within the introduction section, so that the terminal stopper 2 can be fitted securely and easily.

When the terminal stopper 2 is incompletely fitted into the connector housing, the above construction makes it easy to notice the incomplete insertion because the leading end face '10*a*' of the guide bar 10 does not reach the end 1*b* of the introduction section. Additionally, when the terminal stopper 2 is advanced to be fitted, the leading end of the guide bar 10 is the first to contact the connector housing 1 and the terminal stopper 2 is led to be fitted into the connector housing 1 by the guide bar 10, so that the terminal stopping sections 8 are prevented from being broken as a result of their contacting the peripheral wall of the connector housing. Thus, productivity of the connector assembling process and reliability of the connector can be improved remarkably.

In the above example, the guide bar 10 is shaped into a square pole but not limited to such a shape. It may have various cross-sectional shapes to suit the cross-sectional shape of the introduction section 6 formed on the connector housing 1.

Figure 4:
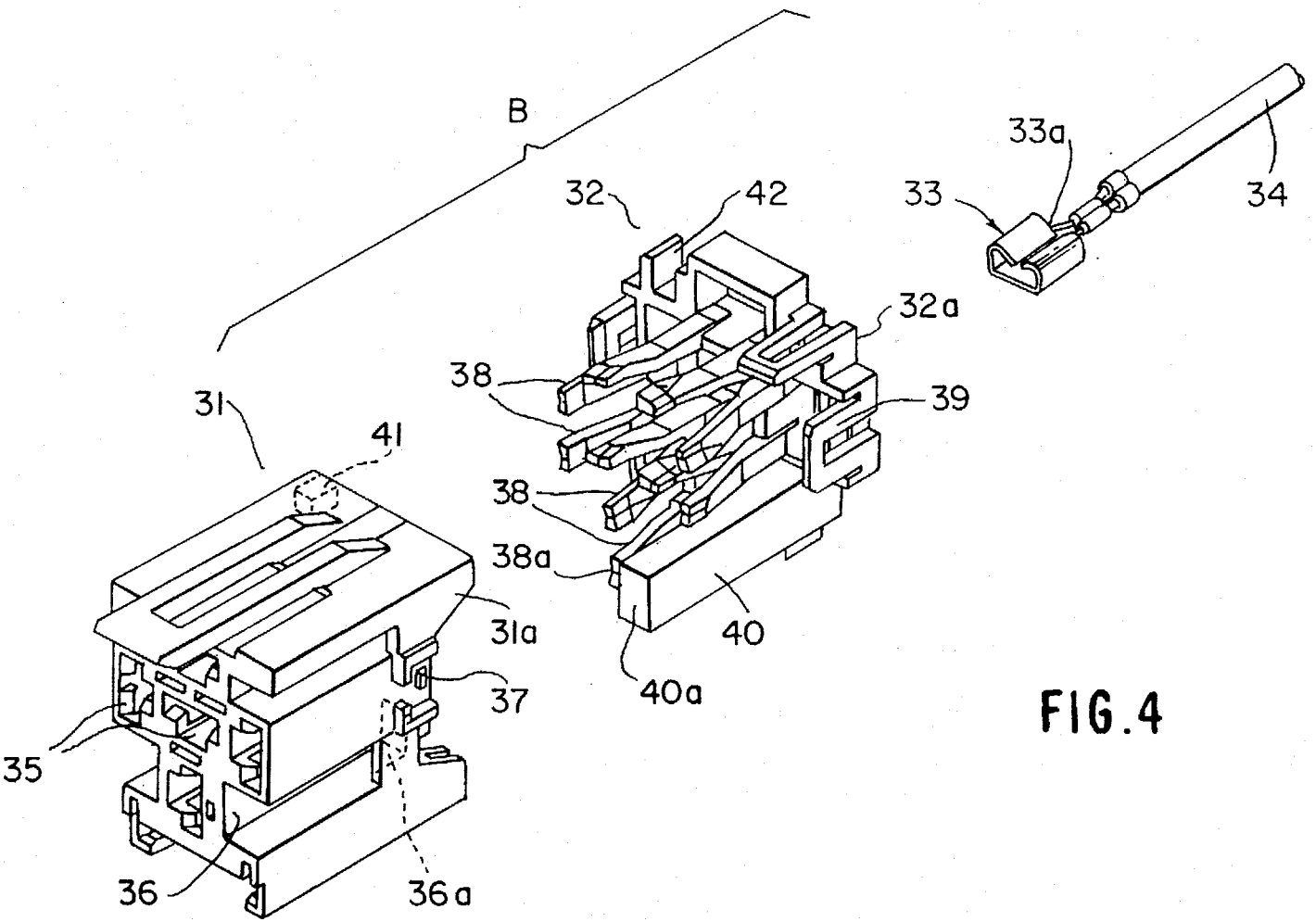
FIG. 4 is a perspective view separately showing the components of another connector with the terminal stopper attached of the present invention.
Figure 5:
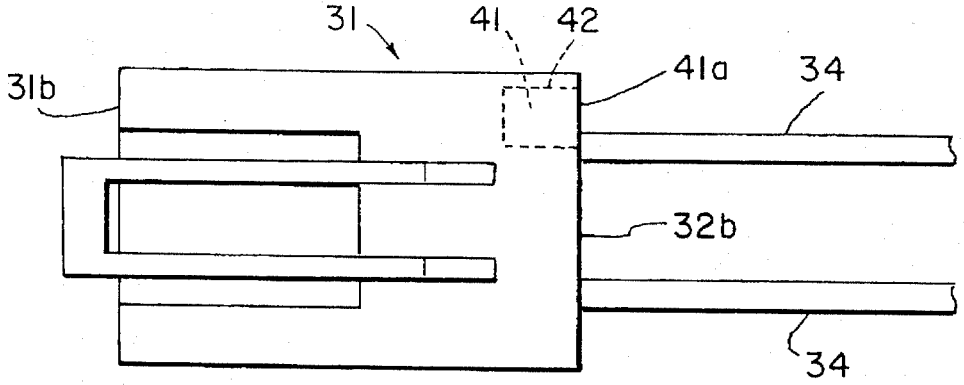
FIG. 5 is a top view showing a state that the terminal stopper and the terminal fittings are inserted into the connector housing of the present invention.
Figure 6:
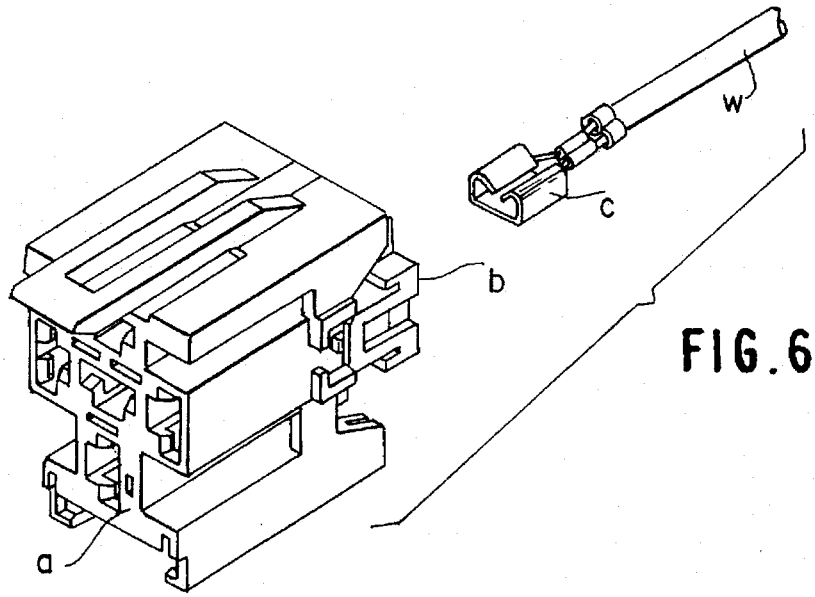
FIG. 6 is a perspective view showing a conventional connector with a terminal stopper attached.
Figure 7:
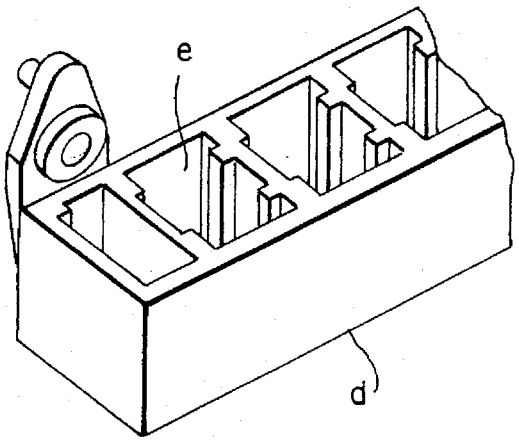
FIG. 7 is a perspective view showing a relay box for fitting a connector.

FIG. 4 is a perspective view separately showing the components of another connector B with a terminal stopper attached of the present invention. FIG. 5 is a top view showing a state that the terminal stopper and the terminal fittings are inserted into the connector housing.

The constitution of connector B is similar to that of connector A as above except that the connector housing 31 is further provided with a guide bar 41 at its side where the terminal stopper 32 is accommodated. This guide bar 41 has a cross-sectional shape which fits with an introduction section 42 further formed on the terminal stopper 32. As shown in FIG. 5, a leading end face '41*a*' of the guide bar 41 is determined to be flush with an end 32*b* of the introduction section of the terminal stopper 32 when the terminal stopper 32 is completely fitted into the connector housing 31.

To fit the terminal stopper 32 into the connector housing 31, the guide bar 40 of the terminal stopper 32 is fitted within an insertion port '36*a*' of the introduction section 36 of the connector housing 31 and is inserted along the introduction section 36. Thereafter, the guide bar 41 of the connector housing 31 is fitted within an insertion port of the introduction section 42 of the terminal stopper 32 and is inserted along the introduction section 42. The stopper claw 37 of the connector housing 31 is connected with the detent 39 of the terminal stopper 32 and they are engaged. In this case, directionality is maintained for the terminal stopper by sliding the guide bar 40 disposed on the terminal stopper 32 within the introduction section 36 of the connector housing 31, so that the terminal stopper 32 can be fitted securely and easily.

When the terminal stopper 32 is incompletely inserted into the connector housing 31, the above construction makes it easy to visually determine that the insertion is incomplete because the leading end face of either of the guide bars does not reach either end of the introduction sections. In addition, when the terminal stopper 32 is advanced to be fitted into the connector housing 31, the leading end of the guide bar 40 is the first to contact the connector housing 31 and the terminal stopper 32 is led to be fitted into the connector housing 31 by the guide bar 40, so that the terminal stopping sections 38 are prevented from being broken caused by their contacting the peripheral wall of the connector housing. Thus, productivity of the connector assembling process and reliability of the connector can be improved remarkably In the above example, the guide bars 40 and 41 are shaped into a square pole but not limited to the square pole. It may have various cross-sectional shapes to suit the cross-sectional shape of the introduction sections 36 and 42 formed on the connector housing 31 and the terminal stopper 32 respectively.

According to this invention, when the terminal stopper is fitted into the connector housing, the guide bar disposed on the terminal stopper and/or in the connector housing is connected with the introduction section disposed in the connector housing and/or on the terminal stopper, so that a proper position for the guide bar insertion can be easily determined. Therefore, the terminal stopper can be exactly fitted into the connector housing by simply pushing in the terminal stopper. And the terminal stopper is provided with the guide bar having the length equal to or longer than the terminal stopping sections, so that the terminal stopping sections can be prevented from carelessly collided with the peripheral wall of the connector housing and being broken. Further, the guide bar disposed on the terminal stopper and/or in the connector housing is determined to have a length to reach the end of the introduction section of the connector housing and/or the terminal stopper, so that the incomplete insertion of the terminal stopper into the connector housing can be easily found.

What is claimed is:

1. A connector comprising:

a connector housing having a plurality of terminal accommodating chambers for respectively receiving a plurality of terminals;

a terminal stopper including a plurality of flexible terminal retaining arms extending in a forward direction which are respectively receivable in said terminal accommodating chambers for retaining the terminals therein, said terminal stopper being engageable with said connector housing and moveable in said forward direction from a provisional position to a final position, wherein said terminals are insertable into said terminal accommodating chambers when said terminal stopper is in said provisional position and wherein said retaining arms engage and retain said terminals when said terminal stopper is in said final position; locking means for locking said terminal stopper to said connector housing; and guide means, separate from said locking means, for guiding said terminal stopper with respect to said connector housing so as to, attendantly, guide said retaining arms into the respective terminal accommodating chambers, said guide means including a substantially rigid guide bar having a predetermined cross-sectional shape protruding from said terminal stopper in said forward direction which is received in a cavity in said connector housing, said cavity having substantially the same cross-sectional shape as said predetermined cross-sectional shape of said guide bar to establish a close fit therebetween.

2. The connector of claim 1, wherein said guide bar extends further in said forward direction than said retaining arms.

3. The connector of claim 1, wherein said cross-sectional shape of said guide bar and said cavity is rectangular.

4. The connector of claim 1, wherein said guide bar extends to the bottom of said cavity when said terminal stopper is in said final position.

5. The connector of claim 1, wherein said guide bar extends a predetermined distance such that a distal end of said guide bar is flush with a forward-most face of said connector housing when said terminal stopper is in said final position.

6. The connector of claim 1, wherein only one guide bar is provided, said guide bar being on one side of said terminal stopper.

7. The connector of claim 1, further comprising lock means for locking said terminal stopper to said connector housing in said provisional and final positions, said locking means being independent of said guide means.

8. The connector of claim 1, wherein said guide means further comprises another guide bar which is secured to said connector housing and received in another cavity formed in said terminal stopper.

9. The connector of claim 8, wherein when said terminal stopper is in said final position, a distal end of said another guide bar is flush with a rearward-most face of said terminal stopper.

* * * * *